US011828020B1

(12) United States Patent
Martelli et al.

(10) Patent No.: US 11,828,020 B1
(45) Date of Patent: Nov. 28, 2023

(54) IRONING APPARATUS AND METHOD

(71) Applicants: John D. Martelli, Pensacola, FL (US); Marsha Martelli, Pensacola, FL (US); David Martelli, Pensacola, FL (US)

(72) Inventors: John D. Martelli, Pensacola, FL (US); Marsha Martelli, Pensacola, FL (US); David Martelli, Pensacola, FL (US)

( * ) Notice: Subject to any disclaimer, the term of this patent is extended or adjusted under 35 U.S.C. 154(b) by 0 days.

(21) Appl. No.: 17/849,602

(22) Filed: Jun. 25, 2022

Related U.S. Application Data

(60) Provisional application No. 63/215,618, filed on Jun. 28, 2021.

(51) Int. Cl.
*D06F 83/00* (2006.01)

(52) U.S. Cl.
CPC ..... *D06F 83/00* (2013.01)

(58) Field of Classification Search
CPC ..... D06F 83/00; D06F 81/00
See application file for complete search history.

(56) References Cited

U.S. PATENT DOCUMENTS 582,129 A * 5/1897 Jone ..... D06F 81/00 38/108
2,278,517 A * 4/1942 John ..... D06F 83/00 38/140
2,314,498 A * 3/1943 Hoagland ..... D06F 81/00 38/103
2,504,560 A * 4/1950 McCrory ..... D06F 81/14 38/140
2,556,815 A * 6/1951 Lovelace ..... D06F 71/32 38/141
2,714,478 A * 8/1955 McCusker ..... D06J 1/00 223/33
3,793,754 A * 2/1974 Harms ..... D06F 85/00 38/141
4,360,984 A * 11/1982 Ruttenberg ..... D06F 83/00 428/317.1
5,329,710 A * 7/1994 Huddleston ..... E05D 1/02 38/104
5,372,506 A * 12/1994 Hambright ..... B43L 13/203 434/84
5,899,160 A * 5/1999 Hoag ..... D05B 35/12 112/439
7,194,967 B2 * 3/2007 Bowlus ..... D05C 9/04 38/102.2
2004/0154512 A1 * 8/2004 Krasnitz ..... D05C 9/04 112/475.18
2018/0179695 A1 * 6/2018 Barlow ..... D06F 83/00

FOREIGN PATENT DOCUMENTS

WO WO-2020129004 A1 * 6/2020 ..... B32B 15/046

* cited by examiner

*Primary Examiner* — Ismael Izaguirre
(74) *Attorney, Agent, or Firm* — J. Nevin Shaffer, Jr.

(57) ABSTRACT

An ironing apparatus and method includes a support structure with a top and a bottom. A heat reflective material is attached to the top of the support structure and a heat impervious ironing material is connected to the heat reflective material. Non-slip material is attached to the bottom of the support structure.

20 Claims, 5 Drawing Sheets

IRONING APPARATUS AND METHOD

CROSS REFERENCE TO RELATED APPLICATION

This application claims the benefit of previously filed U.S. provisional patent application No. 63/215,618 filed Jun. 28, 2022 for an " Ironing Apparatus and Method". The Applicants hereby claim the benefit of this provisional application under 35 U.S.C. §119. The entire content of this provisional application is incorporated herein b this reference.

FIELD OF THE INVENTION

This invention relates to an ironing apparatus and method. In particular, in accordance with one embodiment, the invention relates to an ironing apparatus with a support structure with a top and a bottom. A heat reflective material is attached to the top of the support structure and a heat impervious ironing material is connected to the heat reflective material. Non-slip material is attached to the bottom of the support structure.

BACKGROUND OF THE INVENTION

A problem exists with regard to ironing. By way of example only and not by limitation, ironing boards are not easily transported and are not constructed to accommodate rigid forms with material attached. Further, portable ironing pads are not fixed in form and also provide no ironing surface upon which to iron.

Again for example only and not by limitation, embroidering fabric is done by attaching fabric material to a rigid hoop. The fabric is stretched tight across the hoop frame and stitching is added to the top of the fabric. According to the prior art, When the embroidery is complete, the fabric is removed from the rigid hoop frame. The loose fabric is then ironed but the material is difficult to hold stretched tight and stationary when placed on an ironing board, for example.

Further, the problem is compounded by the need to not only iron the top of the fabric but the bottom as well such that when the fabric is reversed the same slippage issues arise along with the risk of adding new iron creases to the material with the second ironing step.

Thus, there is a need in the art for an ironing device that is configured for use with other structures containing fabric that allows fabric to be ironed while still attached to the other structure.

Further, there is a need for an ironing device that enables complete ironing of the top and bottom of a fabric at the same time.

It therefore is an object of this invention to provide an improved ironing apparatus and method that is connectable with a variety of other structures such that fabric attached to the other structures may be ironed without removing the fabric from the other structure. Further, it is an object of this invention to provide a device that enables the top and bottom of a fabric to be ironed at the same time and that is easy to use and economical in construction.

SUMMARY OF THE INVENTION

Accordingly, the ironing apparatus of the present invention, according to one embodiment, includes a support structure with a top and a bottom. A heat reflective material is attached to the top of the support structure and a heat impervious ironing material is connected to the heat reflective material. Non-slip material is attached to the bottom of the support structure.

All terms used herein are given their common meaning as easily understood with reference to the Figures described herein and the description that follows. Therefore, "heat reflective material" describes material that prevents heat transferring through a material and reflects the heat back toward the source. Many such heat reflective materials are now known and are not described further herein. Likewise, "heat impervious" ironing material is material as known through Which heat transfers without affecting the heat impervious material at normal ironing temperatures. Wool, for example only and not by limitation, is a useful heat impervious ironing material. Still further, "non-slip" material is known which resists movement when in contact with other materials. A tacky substance and/or a rough surface are suitable for the purposes of the invention as well as any other non-slip materials now known or hereafter developed.

According to another aspect of the invention, the support structure is shaped to fit within a larger separate structure to which material to he ironed is attached. In one aspect, the larger separate structure is an embroidery hoop.

In one aspect, the material to be ironed is stitched material.

In another aspect, the stitched material is quilting material.

In a further aspect, the heat impervious ironing material is wool.

In another aspect, the support structure includes a handle.

In one aspect, the support structure is Acrylonitrile butadiene styrene (ABS) plastic.

According to another embodiment, for embroidery hoops with a frame to which material to be ironed is attached, an ironing apparatus consists of a support structure with a top and a bottom where the support structure is configured to fit within the frame. Heat reflective material is attached to the top of the support structure, heat impervious ironing material is connected to the heat reflective material and a non-slip material is attached to the bottom of the support structure.

In one aspect, the heat impervious ironing material is wool.

In another aspect, the support structure includes a handle.

In one aspect, the support structure is Acrylonitrile butadiene styrene (ABS) plastic.

In another aspect, the material to be ironed is stitched material.

In a further aspect, the stitched material is quilting material.

According to another embodiment, for an embroidery hoop with a frame, an ironing method consists of:

a. providing a support structure with a top and a bottom; heat reflective material attached to the top of the support structure; heat impervious ironing material connected to the heat reflective material and non-slip material attached to the bottom of the support structure; and
b. configuring the support structure to fit within the frame.

In one aspect, the method further includes:

a. attaching material to the embroidery hoop frame where the material has a top and a bottom;
b. placing the support structure within the embroidery hoop frame and under bottom of the material attached to the frame; and
c. ironing the top of the material attached to the frame.

In another aspect, the heat impervious ironing material is wool.

In one aspect, the support structure includes a handle.

In one aspect, the support structure is Acrylonitrile butadiene styrene (ABS) plastic.

In a further aspect, the material is quilting material.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
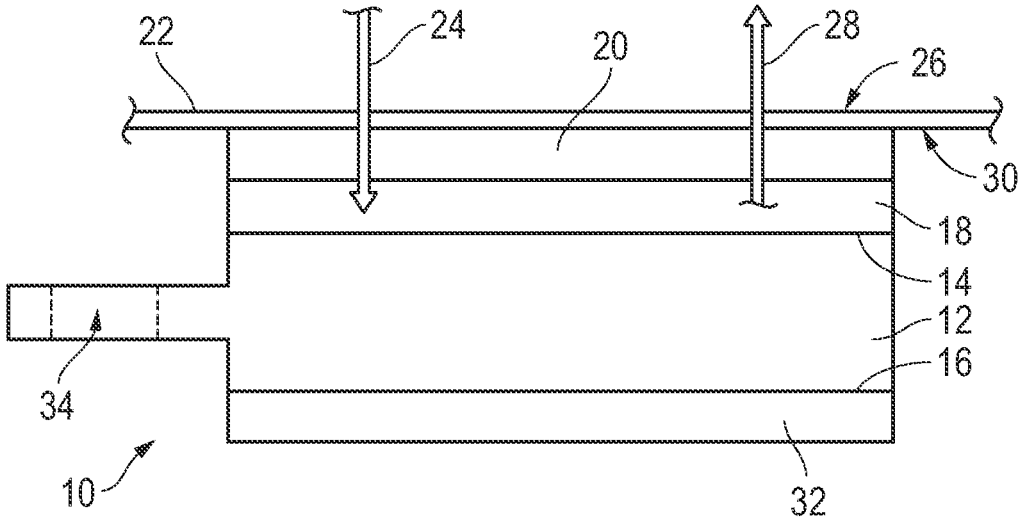
FIG. 1 is a side schematic view of the ironing apparatus of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

The preferred embodiment of the present invention is illustrated by way of example in FIGS. 1-5, With specific reference to FIG. 1, the ironing apparatus and method 10 of the present invention, according to one embodiment, includes a support structure 12 with a top 14 and a bottom 16. Support structure 12 is shaped to fit within a larger separate structure to which material to be ironed is attached as will be described more fully hereafter.

A heat reflective material 18 is attached to the top 14 of the support structure 12 and a heat impervious ironing material 20 is connected to the heat reflective material 18. As a result, the outer surface of the apparatus starts with the heat impervious ironing material 20, then the heat reflective material 18 and then the top 14 of support structure 12 as shown.

When the ironing apparatus 10 is placed beneath fabric material 22 to be ironed, heat arrow 24 shows heat applied from an iron or the like, not shown for clarity, passes through the top 26 fabric material 22 such that the top 26 is ironed. Because of the heat reflective material 18, heat arrow 28 shows that heat is reflected away from support structure 12 and protects support structure 12 from heat damage. Further, heat arrow 28 shows reflected heat is applied to the bottom 30 of fabric material 22 such that both the op 26 and the bottom 28 of fabric material 22 are ironed at the same time.

Still referring to FIG. 1, non-slip material 32 is attached to the bottom 16 of the support structure 12. Applicants have found that non-slip material 32 ensures that the ironing apparatus 10 does not move when ironing is in process. Likewise, Applicants have found that a support structure 12 that includes a handle 34 (more clearly shown in FIGS. 4 and 5) adds a useful device for controlled placement and movement of the apparatus.

In a further aspect, Applicants have found that it is preferred that the support structure 12 is Acrylonitrile butadiene styrene (ABS) plastic. ABS plastic provides for a rigid support structure that is also light weight and economical to produce.

Figure 2:
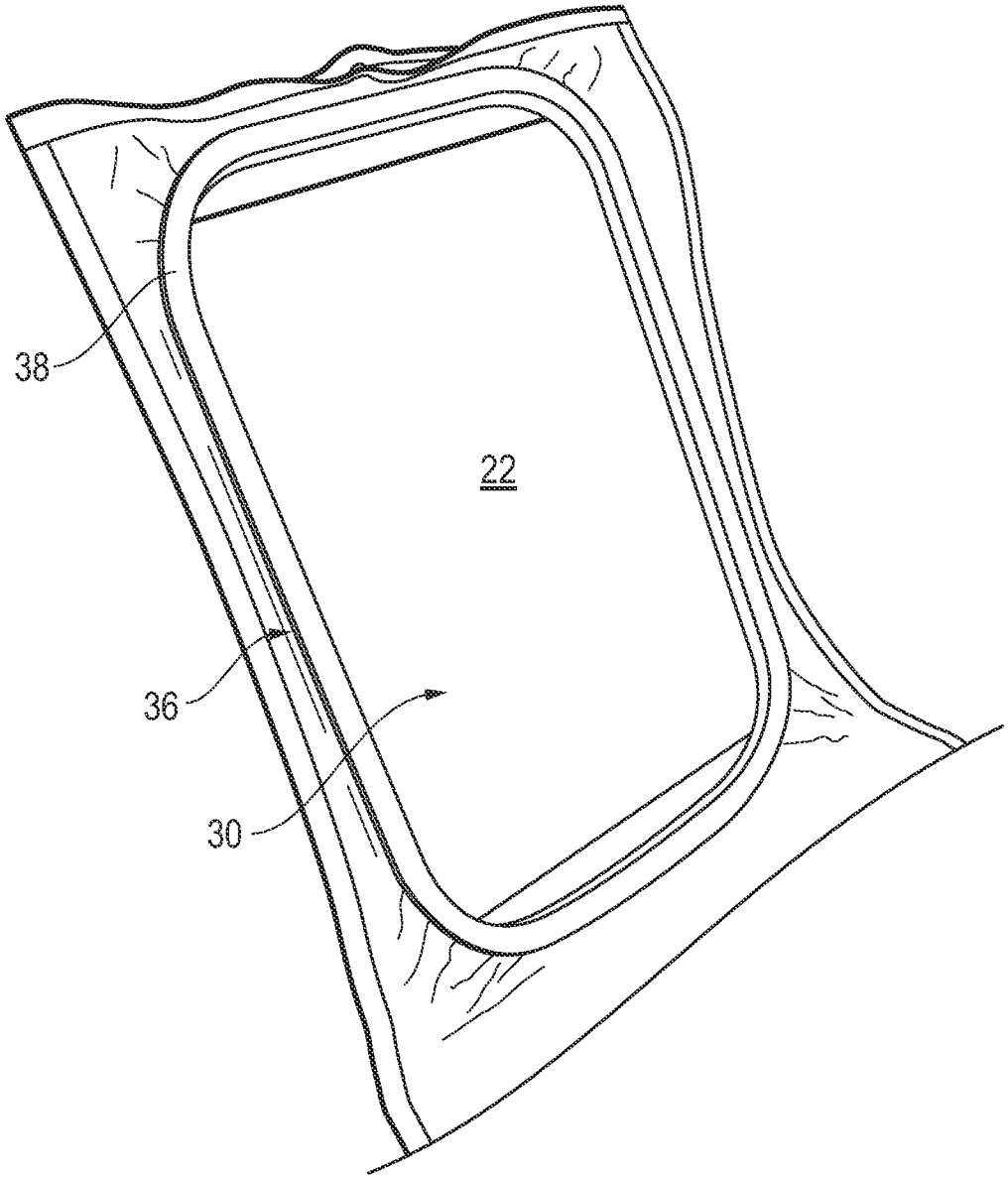
FIG. 2 Prior Art
FIG. 2 is a bottom perspective view of a Prior Art embroidery hoop frame with fabric attached.

Referring now to FIG. 2, a Prior Art embroidery hoop 36 is shown. Embroidery hoop 36 includes a frame 38 to which fabric material 22 to be ironed is attached. As shown, frame 38 defines a shape over which fabric material 22 is secured and which leaves the bottom 30 of fabric material 22 free from obstruction such that ironing apparatus 10, configured to just fit within frame 38, is positionable under the bottom 30 of fabric material 22. In one aspect, the material 22 is stitched material, including quilting material, for example only and not by limitation.

Figure 3:
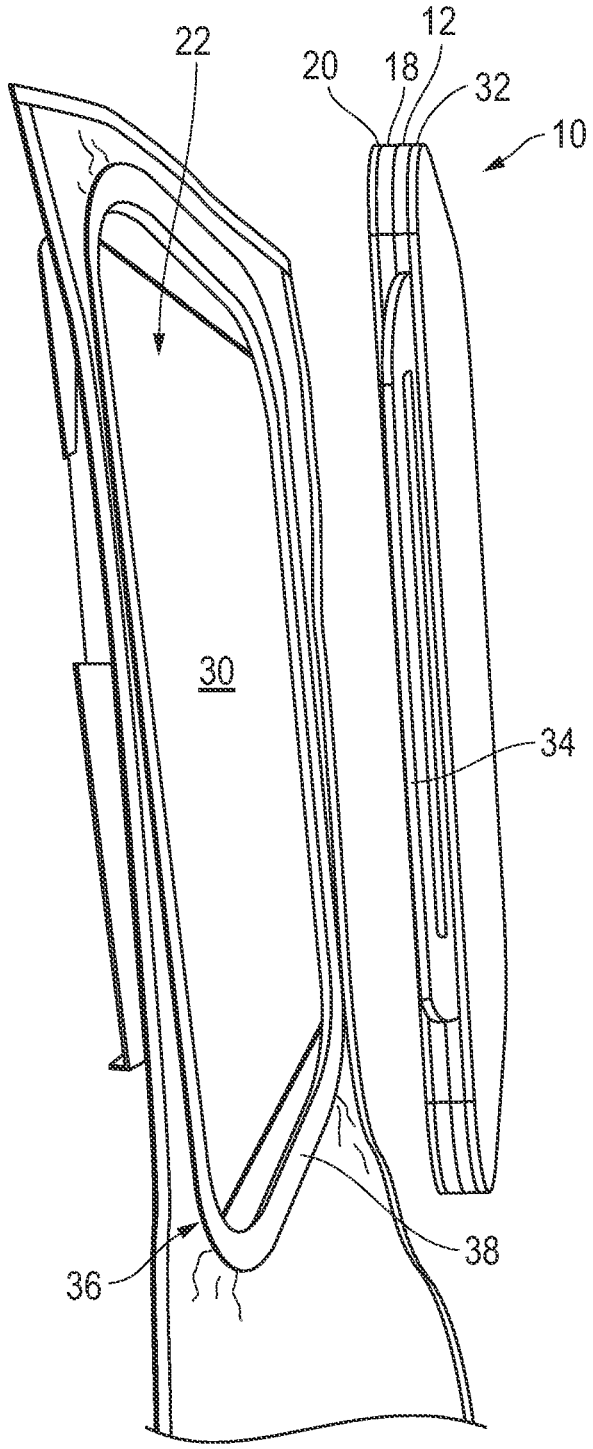
FIG. 3 is a perspective view of the invention of FIG. 1 with the ironing apparatus ready for insertion into the embroidery hoop frame and under the fabric.
Figure 4:
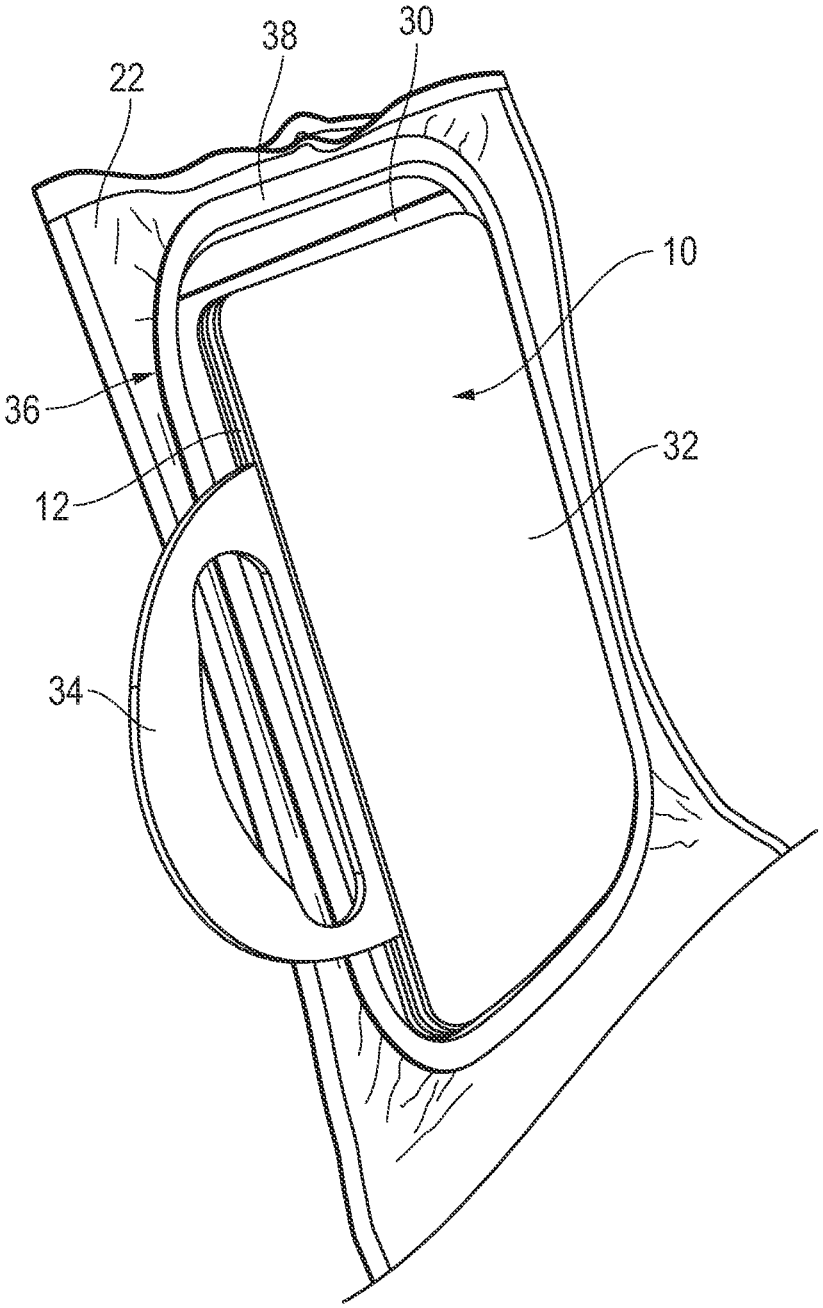
FIG. 4 is a perspective view of the invention of Figure with the apparatus inserted into the embroidery hoop frame and showing the support structure handle.

Referring now to FIGS. 3 and 4, FIG. 3 shows ironing apparatus and method 10 positioned underneath embroidery hoop 36. FIG. 4 shows ironing apparatus and method 10 located within the frame 38. In this position, heat applied to the top 26 of fabric material 22 passes through fabric material 22 and heat impervious material 20 in the direction of heat arrow 24 (see FIG. 1) where it is reflected back to the bottom 30 of fabric material 22 in the direction of heat arrow 28 (see FIG. 1) such that the top 26 and bottom 30 of fabric material 22 are both ironed at the same time while stretched and attached to frame 38 without having to remove fabric material 22 from the frame 38.

Figure 5:
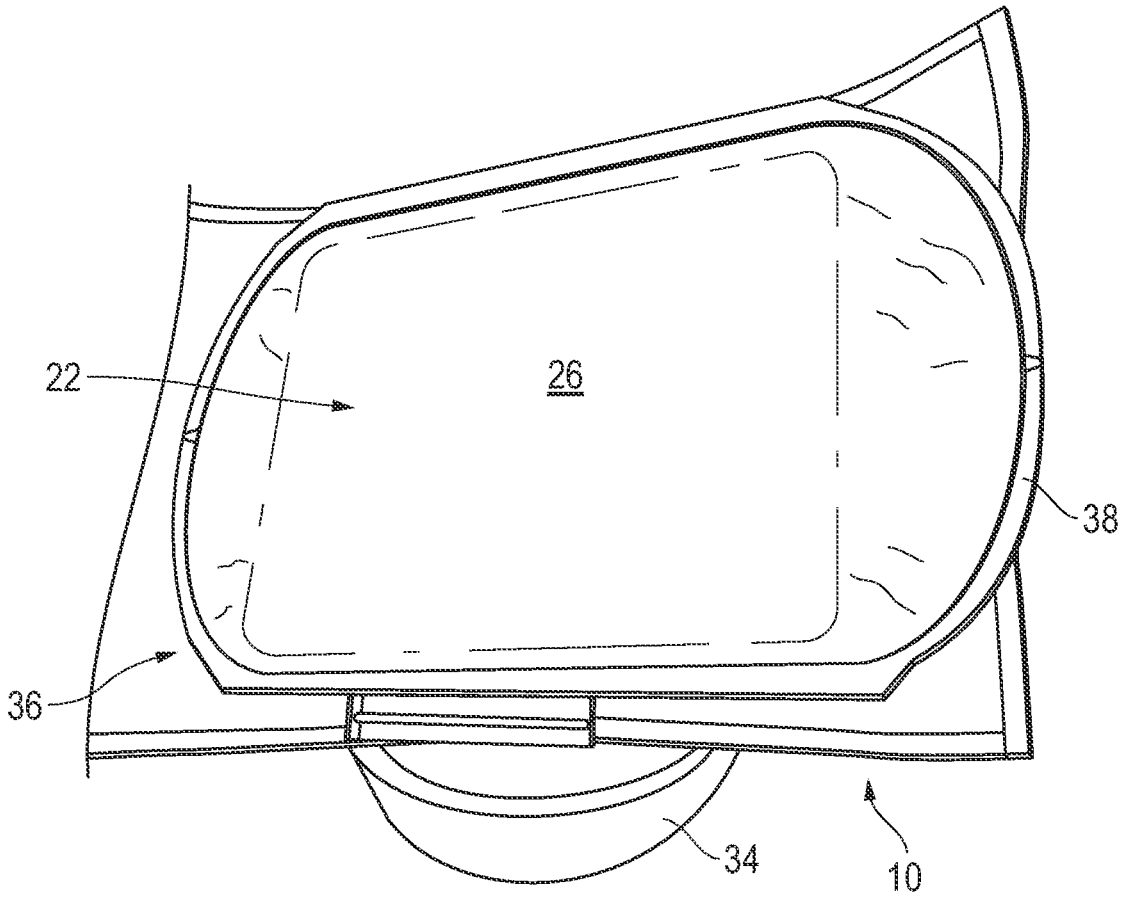
FIG. 5 is a top view of the invention of FIG. 4.

FIG. 5 further illustrates the relation of the ironing apparatus and method 10 underneath fabric material 22 and within frame 38.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. An ironing apparatus comprising:

a. a support structure with a top and a bottom wherein said support structure is shaped to fit within a larger separate structure to which material to be ironed is attached;

b. heat reflective material attached to the top of the support structure;

c. heat impervious ironing material connected to the heat reflective material; and d. non-slip material attached to the bottom of the support structure.

2. The apparatus of claim 1 wherein the tamer separate structure is an embroidery hoop.

3. The apparatus of claim 1 wherein the material to be ironed is stitched material.

4. The apparatus of claim 3 wherein the stitched material is quilting material.

5. The apparatus of claim 1 wherein the heat impervious ironing material is wool.

6. The apparatus of claim 1 wherein the support structure includes a handle.

7. The apparatus of claim 1 wherein he support structure is Acrylonitrile butadiene styrene (ABS) plastic.

8. An ironing apparatus comprising:

a. a support structure with a top and a bottom wherein the support structure is configured to fit within a larger separate structure to which material to be ironed is attached, wherein the larger separate structure is an embroidery hoop and wherein the material to be ironed is stitched material;

b. heat reflective material attached to the op of the support structure;

c. heat impervious ironing material connected to the heat reflective material; and d. a non-slip material attached to the bottom of the support structure.

9. The apparatus of claim 8 wherein the heat impervious ironing material is wool.

10. The apparatus of claim 8 wherein the support structure includes a handle.

11. The apparatus of claim 8 wherein the support structure is Acrylonitrile butadiene styrene (ABS) plastic.

12. The apparatus of claim 8 wherein the stitched material is quilting material.

13. An ironing method comprising:

a. providing a support structure with a top and a bottom wherein said support structure is shaped to fit within a larger separate structure to which material to be ironed is attached; heat reflective material attached to the top of the support structure; heat impervious ironing material connected to the heat, reflective material and non-slip material attached to the bottom of the support structure;

b. attaching material to be ironed to the larger separate structure:

c. placing the support structure within the larger separate structure: and d ironing the material.

14. The method of claim 13: wherein the material to be ironed has a top and a bottom, the method further including:

a. placing the support structure within the larger separate structure and under bottom of the material; and b. ironing the top of the material.

15. The method of claim 13 wherein the heat impervious ironing material is wool.

16. The method of claim 13 wherein the support structure includes a handle.

17. The method of claim 13 wherein the support structure is Acrylonitrile butadiene styrene (ABS) plastic.

18. The method of claim 13 wherein the material to be ironed is quilting material.

19. The method of 13 wherein the larger separate structure is an embroidery hoop.

20. The method of claim 13 wherein the material to be ironed is stitched material.

* * * * *